US008273699B2

(12) United States Patent
Guillard et al.

(10) Patent No.: US 8,273,699 B2
(45) Date of Patent: Sep. 25, 2012

(54) PROCESS FOR PREPARING A PERFUME PARTICLE

(75) Inventors: Nicolas Guillard, Newcastle upon Tyne (GB); Stuart Andrew Caldwell, Northumberland (GB); Edward Sayers, Tyne and Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 26 days.

(21) Appl. No.: 12/888,595

(22) Filed: Sep. 23, 2010

(65) Prior Publication Data

US 2011/0015114 A1 Jan. 20, 2011

Related U.S. Application Data

(63) Continuation of application No. PCT/US2010/041141, filed on Jul. 7, 2010.

(60) Provisional application No. 61/224,159, filed on Jul. 9, 2009.

(51) Int. Cl.
*C11D 3/26* (2006.01)

(52) U.S. Cl. .... 512/4; 428/402; 428/402.2; 428/402.21; 428/402.22; 428/402.24

(58) Field of Classification Search ..... 428/402–402.24
See application file for complete search history.

(56) References Cited

FOREIGN PATENT DOCUMENTS

| | | | |
|---|---|---|---|
| WO | WO 00/02981 | A2 | 1/2000 |
| WO | WO 00/02982 | A2 | 1/2000 |
| WO | WO 00/02986 | A2 | 1/2000 |
| WO | WO 00/02987 | A2 | 1/2000 |
| WO | WO 01/04084 | A1 | 1/2001 |
| WO | WO 01/04247 | A1 | 1/2001 |
| WO | WO 01/04248 | A1 | 1/2001 |
| WO | WO 01/34752 | A1 | 5/2001 |
| WO | WO 01/46373 | A1 | 6/2001 |
| WO | WO 01/46374 | A1 | 6/2001 |
| WO | WO 01/51599 | A1 | 7/2001 |

OTHER PUBLICATIONS

PCT International Search Report, dated mailed: Nov. 16, 2010, 11 pages.

*Primary Examiner* — Kuo-Liang Peng

(74) *Attorney, Agent, or Firm* — Tiffany M Zerby; Gary J Foose

(57) ABSTRACT

A process for preparing a perfume composition, the process having the steps of; (a) contacting a perfume ingredient with a molten material to form a pre-mix; (b) contacting the pre-mix with a first solid material to form a soft-solid intermediate high active perfume material; (c) solidifying the molten material to form a hardened-solid intermediate high active perfume material; (d) contacting the hardened-solid intermediate high active perfume intermediate material with a second solid material to form a perfume composition, wherein the ratio of the wt % amount of perfume ingredient present in the hardened-solid intermediate high active perfume material to the wt % amount of perfume ingredient present in the perfume composition is greater than 1.5:1.

14 Claims, No Drawings

PROCESS FOR PREPARING A PERFUME PARTICLE

CROSS REFERENCE TO RELATED APPLICATION

This application is a Continuation of International Application No. PCT/US2010/041141, filed Jul. 7, 2010, which claims the benefit of U.S. Provisional Application No. 61/224,159, filed Jul. 9, 2009.

FIELD OF THE INVENTION

The present invention relates to a process for preparing a perfume composition. The process of the present invention increases the production capacity of existing perfume processes without the need for extensive modifications to the existing equipment and avoids the excessive capital cost required to install additional complete perfume manufacturing set-ups. The perfume composition produced by the process of the present invention is storage stable, does not require refrigerated transport and storage, has good powder characteristics, and exhibits good flowability profiles. The perfume composition produced by the process of the present invention is suitable for use in a variety of perfume applications and consumer goods; and is especially suitable for incorporation into laundry detergent compositions to impart a dry-fabric odor benefit to laundered garments. The perfume composition produced by the process of the present invention typically comprises a perfume ingredient that is the product of a chemical reaction between an amine and an aldehyde or a ketone.

BACKGROUND OF THE INVENTION

In response to recent consumer demands by high scent seeking consumers to have laundry detergent compositions that provide excellent dry fabric odor benefits, laundry detergent manufacturers have developed perfume technologies, such as the product of a reaction between a delta damascone and a polyethyleneimine, that deposit onto the fabric during the laundering process and deliver excellent dry fabric odour benefits. This consumer demand has not diminished, but instead has increased as more and more consumers are demanding excellent perfume performances from their laundry detergent powders. Many perfume processing plants are running at capacity and prior to the present invention the only way laundry detergent manufacturers can meet this demand with their current processing set up is to install additional perfume processing plants at significant cost.

Attempts at increasing the perfume activity in the perfume particles has resulted in perfume particles that are very soft, have poor powder characteristics and poor flowability profiles, especially when they are produced, transported and/or stored in hot and conditions, such as in countries like Saudi Arabia, Egypt and other countries where ambient temperatures of above 30° C. are not uncommon.

The Inventors have overcome this problem by providing a process as defined by claim 1. The process of the present invention increases the production capacity of existing perfume processes without the need for extensive modifications to the existing equipment and avoids the excessive capital cost required to install a new complete perfume manufacturing set-up. The perfume particles produced by the process of the present invention are storage stable, do not require refrigerated transport and storage, have good powder characteristics, and exhibit good flowability profiles. The perfume particles produced by the process of the present invention are suitable for use in a variety of perfume applications and consumer goods; they are especially suitable for incorporation into laundry detergent compositions to impart a dry-fabric odor benefit to laundered garments.

WO00/02981, WO00/02982, WO00/02986, WO00/02987, WO01/04248, WO01/34752, WO01/04084, WO01/04247, WO01/46373, WO01/46374 and WO01/51599 all relate to perfume compositions.

SUMMARY OF THE INVENTION

The present invention provides a process as defined by claim 1.

DETAILED DESCRIPTION OF THE INVENTION

Process

The process for preparing a perfume composition comprises the steps of; (a) contacting a perfume ingredient with a molten material to form a pre-mix; (b) contacting the pre-mix with a first solid material to form a soft-solid intermediate high active perfume material; (c) solidifying the molten material to form a hardened-solid intermediate high active perfume material; (d) contacting the hardened-solid intermediate high active perfume intermediate material with a second solid material to form a perfume composition, wherein the ratio of the wt % amount of perfume ingredient present in the hardened-solid intermediate high active perfume material to the wt % amount of perfume ingredient present in the perfume composition is greater than 1.5:1.

The perfume ingredient and molten material are contacted together in any suitable vessel, typically this is a twin-screw extruder but it can also be a Schugi mixer or a Lodige mixer such as Lodige CB, or any other high or moderate-shear mixer. Typically, step (a) is carried out at a temperature at least 5° C., or at least 10° C., or at least 15° C., or even at least 20° C. hotter than the melting peak temperature of the molten material. Typically, step (a) is carried out at a temperature of from 40° C. to 80° C. When the molten material is contacted with the perfume ingredient, it is typically at a temperature above, preferably at least 5° C., or at least 10° C., or at least 15° C., or even at least 20° C. hotter than its melting peak temperature. When the molten material is contacted with the perfume ingredient, it is typically at a temperature of from 40° C. to 80° C. It may also be preferred for at least part, and preferably all, of the perfume ingredient to be heated above ambient conditions before it is contacted to the molten material. Before the perfume ingredient is contacted with the molten material, it may be preferred that at least part, and preferably all, of the perfume ingredient to be heated above ambient temperature. Before the perfume ingredient is contacted with the molten material, it may be preferred that at least part, and preferably all, of the perfume ingredient is at a temperature above, preferably at least 5° C., or at least 10° C., or at least 15° C., or even at least 20° C. above the melting peak temperature of the molten material. Before the perfume ingredient is contacted with the molten material, it may be preferred that at least part, and preferably all, of the perfume ingredient is at a temperature of from 40° C. to 80° C.

The pre-mix is optionally transferred to a buffer tank and then to a hold tank. Prior to contacting the pre-mix with the first solid material, the temperature of the pre-mix is preferably maintained above the melting peak temperature of the molten material. The pre-mix may be transferred to a heat exchange vessel, such as a Chemetator. The pre-mix is contacted with a first solid material to form a soft-solid intermediate high active perfume material. Step (b) is typically carried out in a high- or moderate-shear mixer, such as a Lodige CB30. Optionally, step (b) can be carried out in two mixers, for example a Lodige C30 and a Lodige KM200.

The molten material comprised by the soft-solid intermediate high active perfume material is then solidified to form a hard-solid intermediate high active perfume material. Typically, the soft-solid intermediate high active perfume material is cooled, typically being subjected to a temperature, preferably an air temperature, of at least below, preferably at least 5° C. below, or even at least 10° C. below, or even at least 15° C. below, or even at least 20° C. below, the crystallization peak temperature of the molten material, to form a hard-solid intermediate high active perfume material. Preferably, the soft-solid intermediate high active perfume material is passed through a fluid bed cooler.

The hard-solid intermediate high active perfume material is contacted with a second solid material to form a perfume composition. Typically, step (d) is carried out in a mixing drum or some other vessel, such as a Lodige CB30 or KM200.

The ratio of the wt % amount of perfume ingredient present in the hardened-solid intermediate high active perfume material to the wt % amount of perfume ingredient present in the perfume composition is greater than 1.5:1, preferably greater than 1.6:1, or greater than 1.7:1, or greater than 1.8:1, or greater than 1.9:1, or greater than 2.0:1, or greater than 2.1:1, or greater than 2.2:1, or greater than 2.3:1, or greater than 2.4:1, or even greater than 2.5:1, and typically to 1,000:1, or to 500:1, or to 100:1, or to 50:1, or to 25:1, or to 10:1.

Perfume Composition

The perfume composition is suitable for use in a variety of perfume applications, but the perfume composition is especially suitable for incorporation into a laundry detergent composition, especially a solid laundry detergent composition. Preferably, the perfume composition comprises less than 10 wt % perfume ingredient, preferably less than 9 wt %, or less than 8 wt %, or less than 7 wt %, or less than 6 wt %, or even less than 5 wt % perfume ingredient.

The perfume composition typically has a tan Delta of less than 0.4, preferably less than 0.35, or even less than 0.3 at 20° C. The method for determining the Tan delta of the perfume composition is described in more detail below.

Pre-mix

The pre-mix comprises a perfume ingredient and a molten material.

Perfume Ingredient

The perfume ingredient can be any volatile compound, or mixtures thereof, that impart an olfactory benefit. Preferably, the perfume ingredient comprises the reaction product of an amine compound with an aldehyde or ketone. Preferably, the perfume ingredient is the reaction product of an amine with an aldehyde or ketone.

A typical disclosure of suitable perfume ketones and perfume aldehydes, traditionally used in perfumery, can be found in "perfume and Flavor Chemicals", Vol. I and II, S. Arctander, Allured Publishing, 1994, ISBN 0-931710-35-5.

Preferably, the perfume ketone is selected from buccoxime; iso jasmone; methyl beta naphthyl ketone; musk indanone; tonalid/musk plus; Alpha-Damascone, Beta-Damascone, Delta-Damascone, Iso-Damascone, Damascenone, Damarose, Methyl-Dihydrojasmonate, Menthone, Carvone, Camphor, Fenchone, Alpha-Ionone, Beta-Ionone, Gamma-Methyl so-called Ionone, Fleuramone, Dihydrojasmone, Cis-Jasmone, Iso-E-Super, Methyl-Cedrenyl-ketone or Methyl-Cedrylone, Acetophenone, Methyl-Acetophenone, Para-Methoxy-Acetophenone, Methyl-Beta-Naphtyl-Ketone, Benzyl-Acetone, Benzophenone, Para-Hydroxy-Phenyl-Butanone, Celery Ketone or Livescone, 6-Isopropyldecahydro-2-naphtone, Dimethyl-Octenone, Freskomenthe, 4-(1-Ethoxyvinyl)-3,3,5,5,-tetramethyl-Cyclohexanone, Methyl-Heptenone, 2-(2-(4-Methyl-3-cyclohexen-1-yl)propyl)-cyclopentanone, 1-(p-Menthen-6(2)-yl)-1-propanone, 4-(4-Hydroxy-3-methoxyphenyl)-2-butanone, 2-Acetyl-3,3-Dimethyl-Norbornane, 6,7-Dihydro-1,1,2,3,3-Pentamethyl-4(5H)-Indanone, 4-Damascol, Dulcinyl or Cassione, Gelsone, Hexalon, Isocyclemone E, Methyl Cyclocitrone, Methyl-Lavender-Ketone, Orivon, Para-tertiary-Butyl-Cyclohexanone, Verdone, Delphone, Muscone, Neobutenone, Plicatone, Veloutone, 2,4,4,7-Tetramethyl-oct-6-en-3-one, Tetrameran, and mixtures thereof. Preferably the perfume ketone is selected from Alpha Damascone, Delta Damascone, Iso Damascone, Carvone, Gamma-Methyl-Ionone, Iso-E-Super, 2,4,4,7-Tetramethyl-oct-6-en-3-one, Benzyl Acetone, Beta Damascone, Damascenone, methyl dihydrojasmonate, methyl cedrylone, and mixtures thereof. Most preferably, the perfume ketone is Delta damascone.

Preferably, the perfume aldehyde is selected from adoxal; anisic aldehyde; cymal; ethyl vanillin; florhydral; helional; heliotropin; hydroxycitronellal; koavone; lauric aldehyde; lyral; methyl nonyl acetaldehyde; P. T. bucinal; phenyl acetaldehyde; undecylenic aldehyde; vanillin; 2,6,10-trimethyl-9-undecenal, 3-dodecen-1-al, alpha-n-amyl cinnamic aldehyde, 4-methoxybenzaldehyde, benzaldehyde, 3-(4-tert butylphenyl)-propanal, 2-methyl-3-(para-methoxyphenyl propanal, 2-methyl-4-(2,6,6-trimethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzyaldehyde, 1,2,3,4,5,6,7,8-octahydro-8,8-dimethyl-2-naphthaldehyde, 2,4-dimethyl-3-cyclohexen-1-carboxaldehyde, 2-methyl-3-(isopropylphenyl)propanal, 1-decanal; decyl aldehyde, 2,6-dimethyl-5-heptenal, 4-(tricyclo [5.2.1.0(2,6)]-decylidene-8)-butanal, octahydro-4,7-methano-1H-indenecarboxaldehyde, 3-ethoxy-4-hydroxy benzaldehyde, para-ethyl-alpha, alpha-dimethyl hydrocinnamaldehyde, alpha-methyl-3,4-(methylenedioxy)-hydrocinnamaldehyde, 3,4-methylenedioxybenzaldehyde, alpha-n-hexyl cinnamic aldehyde, m-cymene-7-carboxaldehyde, alpha-methyl phenyl acetaldehyde, 7-hydroxy-3,7-dimethyl octanal, Undecenal, 2,4,6-trimethyl-3-cyclohexene-1-carboxaldehyde, 4-(3)(4-methyl-3-pentenyl)-3-cyclohexen-carboxaldehyde, 1-dodecanal, 2,4-dimethyl cyclohexene-3-carboxaldehyde, 4-(4-hydroxy-4-methyl pentyl)-3-cylohexene-1-carboxaldehyde, 7-methoxy-3,7-dimethyloctan-1-al, 2-methyl undecanal, 2-methyl decanal, 1-nonanal, 1-octanal, 2,6,10-trimethyl-5,9-undecadienal, 2-methyl-3-(4-tertbutyl)propanal, dihydrocinnamic aldehyde, 1-methyl-4-(4-methyl-3-pentenyl)-3-cyclohexene-1-carboxaldehyde, 5 or 6 methoxy0hexahydro-4,7-methanoindan-1 or 2-carboxaldehyde, 3,7-dimethyloctan-1-al, 1-undecanal, 10-undecen-1-al, 4-hydroxy-3-methoxy benzaldehyde, 1-methyl-3-(4-methylpentyl)-3-cyclhexenecarboxaldehyde, 7-hydroxy-3,7-dimethyl-octanal, trans-4-decenal, 2,6-nonadienal, para-tolylacetaldehyde; 4-methylphenylacetaldehyde, 2-methyl-4-(2,6,6-trimethyl-1-cyclohexen-1-yl)-2-butenal, ortho-methoxycinnamic aldehyde, 3,5,6-trimethyl-3-cyclohexene carboxaldehyde, 3,7-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindan-1-carboxaldehyde, 2-methyl octanal, alpha-methyl-4-(1-methyl ethyl) benzene acetaldehyde, 6,6-dimethyl-2-norpinene-2-propionaldehyde, para methyl phenoxy acetaldehyde, 2-methyl-3-phenyl-2-propen-1-al, 3,5,5-trimethyl hexanal, Hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonyl acetaldehyde, hexanal, trans-2-hexenal, 1-p-menthene-q-carboxaldehyde and mixtures thereof. Most preferred perfume aldehydes are selected from 1-decanal, benzaldehyde, florhydral, 2,4-dimethyl-3-cyclohexen-1-carboxaldehyde; cis/trans-3,7-dimethyl-2,6-octadien-1-al; heliotropin; 2,4,6-trimethyl-3-cyclohexene-1-carboxaldehyde; 2,6-nonadienal; alpha-n-amyl cinnamic aldehyde, alpha-n-hexyl cinnamic aldehyde, P. T. Bucinal, lyral, cymal, methyl nonyl acetaldehyde, hexanal, trans-2-hexenal, and mixtures thereof.

In the above list of perfume ingredients, some are commercial names conventionally known to one skilled in the art, and also includes isomers. Such isomers are also suitable for use in the present invention.

Preferably, the amine compound is selected from: amine-functionalised silicones, such as polyaminoalkyl polysiloxanes; aminoaryl derivatives wherein the amino group is covalently bonded directed to a benzene group; aminoacids and derivatives thereof; polyamines including polyethyleneimines, preferably polyethyleneimines sold under the tradename Lupasol™; and mixtures thereof. Especially preferred amine compounds are polyamines, and especially preferred are polyethyleneimines.

Preferably, the perfume ingredient comprises the reaction product of polyethylene imine and delta-damascone. Typically, the perfume ingredient is the reaction product of polyethylene imine and delta-damascone. Typically, the perfume ingredient is a Schiff base reaction product, especially of the reaction between polyethyleneimine and delta-damascone.

Molten Material

The molten material comprises, and preferably is, a compound selected from polyethylene glycols, alkoxylated alcohols, wax, paraffin, and mixtures thereof. Preferably, the molten material comprises, and preferably is, an alkoxylated alcohol. Preferred alkoxylated alcohols are $C_{8-24}$ alkyl alkoxylated alcohols, preferably $C_{16-18}$ alkoxylated alcohols, most preferably tallow alkoxylated alcohols. Preferably, the alkoxylated alcohols are ethoxylated alcohols. Preferably, the alkoxylated alcohols have an average degree of alkoxylation of from 20 to 100, preferably from 50 to 100, most preferably 80. Preferably, the alkoxylated alcohol is a $C_{8-24}$ alkyl ethoxylated alcohol having an average degree of ethoxylation of from 20 to 100, preferably from 25 to 100. Most preferably, the alkoxylated alcohol is tallow alkyl ethoxylate having an average degree of ethoxylation of from 20 to 100, preferably from 25 to 100, or from 50 to 100 and preferably 80. Typically, the molten material has a melting peak temperature in the range of from above 20° C. to below 60° C., preferably from 30° C. to 50° C. Typically the molten material has a crystallization peak temperature in the range of from above 20° C. to below 60° C., preferably from 30° C. to 50° C. The method to determine the melting peak temperature and crystallization peak temperature is described in more detail below.

First Solid Material and Second Solid Material

The first solid material and the second solid material independently comprise compounds selected from, and preferably are compounds independently selected from: perborate salts, especially sodium perborate; silicate salts, including sodium silicate, amorphous sodium silicate and crystalline layered sodium silicate; sodium carbonate, especially light density sodium carbonate; sodium bicarbonate; magnesium sulphate, sodium sulphate; sodium chloride; sodium phosphate, including sodium tripolyphosphate; clay, including smectite clay such as bentonite clay (also known as montmorilonite clay); zeolite, especially zeolite 4A and zeolite MAP; and mixtures thereof. Especially preferred are sodium carbonate, sodium bicarbonate, sodium sulphate, zeolite, clay and mixtures thereof. Especially preferred is sodium carbonate. Preferred sodium carbonate has a bulk density of less than 1,000 g/l, or less than 900 g/l, or less than 800 g/l, or less than 700 g/l, or less than 600 g/l, or less than 500 g/l, or less than 400 g/l, or less than 300 g/l, or even less than 200 g/l. Especially preferred is light density sodium carbonate. The method used to determine the bulk density of the sodium carbonate is described in more detail below in the section titled: "Method for determining the bulk density of a powder".

Soft-solid Intermediate High Active Perfume Material

The soft-solid intermediate high active perfume material typically has a Tan delta of at least 0.5, preferably at least 0.55, or at least 0.6, or even at least 0.7 at 60° C. The method for determining the Tan delta of the soft-solid intermediate high active perfume material is described in more detail below.

The soft-solid intermediate high active perfume material typically comprises at least 5 wt %, preferably at least 6 wt %, or at least 7 wt %, or at least 8 wt %, or at least 9 wt %, or at least 10 wt %, or at least 11 wt %, or at least 12 wt %, or at least 13 wt %, or at least 14 wt %, or at least 15 wt %, or at least 16 wt %, or at least 17 wt %, or at least 18 wt %, or at least 19 wt %, or even at least 20 wt % perfume ingredient.

Hardened-solid Intermediate High Active Perfume Material

The hardened-solid intermediate high active perfume material typically has a tan Delta of less than 0.5, preferably less than 0.45, or even less than 0.4 at 20° C. The method for determining the Tan delta of the hardened-solid intermediate high active perfume material is described in more detail below.

The hardened-solid intermediate high active perfume material typically comprises at least 5 wt %, preferably at least 6 wt %, or at least 7 wt %, or at least 8 wt %, or at least 9 wt %, or at least 10 wt %, or at least 11 wt %, or at least 12 wt %, or at least 13 wt %, or at least 14 wt %, or at least 15 wt %, or at least 16 wt %, or at least 17 wt %, or at least 18 wt %, or at least 19 wt %, or even at least 20 wt % perfume ingredient.

Method for Determining the Bulk Density of a Powder

The bulk density is typically determined by the following method:

Summary: A 500 ml graduated cylinder is filled with a powder, the weight of the sample is measured and the bulk density of the powder is calculated in g/l.

Equipment:

1. Balance. The balance has a sensitivity of 0.5 g.
2. Graduated cylinder. The graduated cylinder has a capacity 500 ml. The cylinder should be calibrated at the 500 ml mark, by using 500 g of water at 20° C. The cylinder is cut off at the 500 ml mark and ground smooth.
3. Funnel. The funnel is cylindrical cone, and has a top opening of 110 mm diameter, a bottom opening of 40 mm diameter, and sides having a slope of 76.4° to the horizontal.
4. Spatula. The spatula is a flat metal piece having of a length of at least 1.5 times the diameter of the graduated cylinder.
5. Beaker. The beaker has a capacity of 600 ml.
6. Tray. The tray is either a metal or plastic square, is smooth and level, and has a side length of at least 2 times the diameter of the graduated cylinder.
7. Ring stand.
8. Ring clamp.

9. Metal gate. The metal gate is a smooth circular disk having a diameter of at least greater than the diameter of the bottom opening of the funnel.

Conditions: The procedure is carried out indoors at conditions of 20° C. temperature, $1\times10^5$ $Nm^{-2}$ pressure and a relative humidity of 25%.

Procedure:

1. Weigh the graduated cylinder to the nearest 0.5 g using the balance. Place the graduated cylinder in the tray so that it is horizontal with the opening facing upwards.
2. Support the funnel on a ring clamp, which is then fixed to a ring stand such that the top of the funnel is horizontal and rigidly in position. Adjust the height of the funnel so that its bottom position is 38 mm above the top centre of the graduated cylinder.
3. Support the metal gate so as to form an air-tight closure of the bottom opening of the funnel.
4. Completely fill the beaker with a 24 hour old powder sample and pour the powder sample into the top opening of the funnel from a height of 2 cm above the top of the funnel.
5. Allow the powder sample to remain in the funnel for 10 seconds, and then quickly and completely remove the metal gate so as to open the bottom opening of the funnel and allow the powder sample to fall into the graduated cylinder such that it completely fills the graduated cylinder and forms an overtop. Other than the flow of the powder sample, no other external force, such as tapping, moving, touching, shaking, etc, is applied to the graduated cylinder. This is to minimize any further compaction of the powder sample.
6. Allow the powder sample to remain in the graduated cylinder for 10 seconds, and then carefully remove the overtop using the flat edge of the spatula so that the graduated cylinder is exactly full. Other than carefully removing the overtop, no other external force, such as tapping, moving, touching, shaking, etc, is applied to the graduated cylinder. This is to minimize any further compaction of the powder sample.
7. Immediately and carefully transfer the graduated cylinder to the balance without spilling any powder sample. Determine the weight of the graduated cylinder and its powder sample content to the nearest 0.5 g.
8. Calculate the weight of the powder sample in the graduated cylinder by subtracting the weight of the graduated cylinder measured in step 1 from the weight of the graduated cylinder and its powder sample content measured in step 7.
9. Immediately repeat steps 1 to 8 with two other replica powder samples.
10. Determine the mean weight of all three powder samples.
11. Determine the bulk density of the powder sample in g/l by multiplying the mean weight calculated in step 10 by 2.0.

Method to Determine the tan Delta

The Tan delta is determined using a dynamic mechanical analyser (DMA) following the procedure described in the annual book of ASTM standards, 2000, volume 08.02, pages 558-563, ASTM D 4065. Specifically:

1. The powder to be tested is loaded into a cylindrical die set (10 mm diameter), and the powder surface is leveled using the flat edge of a spatula so that the die is exactly full.
2. The die set is introduced to an Instron Compaction Tester and a peak consolidation (compression) force of 1.0 kN is applied at a speed of 10 mm/min.
3. The tablet formed is removed from the die set using a twisting action to avoid surface degradation/breakage.
4. The tablet is then presented to the DMA, which is fitted with a 15 mm parallel plate configuration.
5. The temperature scan is run at fixed amplitude of oscillation regulated by dynamic force control at a test frequency 1.0 $s^{-1}$. The rate of temperature increase is set at 1° C./min and the dynamic force fixed at a 110% ratio to static force.

Method to Determine the Melting Peak Temperature

The melting peak temperature is typically determined using the method described in the annual book of ASTM standards, 2000, volume 08.02, pages 3228-332, ASTM D 3418, except that in steps 10.1.2, 10.1.4 and 10.1.5 the temperature rate is 1° $Cmin^{-1}$ as opposed to the stated 10° C $min^{-1}$.

Method to Determine the Crystallization Peak Temperature

The crystallization peak temperature is typically determined using the method described in the annual book of ASTM standards, 2000, volume 08.02, pages 3228-332, ASTM D 3418, except that in steps 10.1.2, 10.1.4 and 10.1.5 the temperature rate is 1° $Cmin^{-1}$ as opposed to the stated 10° C. $min^{-1}$.

EXAMPLES

Example 1

Preparation of the Pre-mix

Tallow alkyl ethoxylate having an average degree of ethoxylation of 80 ($TAE_{80}$) and polyethyleneimine are kept at usage temperature through storage in separate heated tanks at a temperature of 75° C. and 60° C. respectively. Delta damascone is stored in an additional tank kept at ambient temperature (20° C.). The delta damascone and heated polyethyleneimine are pumped into the first barrel of a Wenger TX57 twin screw extruder at a rate of 72 kg/hr and 48 kg/hr respectively to form the perfume ingredient. To this, the molten $TAE_{80}$ is added in barrel 3 at a rate of 180 kg/hr and mixed together through barrels 3 to 5 of the extruder to form a pre-mix. The twin screw extruder is run at the following conditions:

Screw speed: 300 rpm

Barrel temperature: 75° C.

Pre-mix exit temperature 70° C.

The composition of the resulting pre-mix is included in the table below.

| Component | % w/w of pre-mix |
|---|---|
| $TAE_{80}$ | 60 |
| Delta Damascone | 24 |
| Polyethyleneimine | 16 |

Example 2

Preparation of the Soft-Solid Intermediate High Active Perfume Material 600 g of pre-mix from example 1 is immediately dispersed with 577.5 g of light sodium carbonate and 247.5 g of ester modified carboxymethyl cellulose using a Processall Tilt-a-pin mixer run at 900 rpm for 20 seconds. The Tilt-a-pin mixer is run with a hot water jacket at a temperature of 70° C. This material is then immediately transferred into a Processall Tilt-a-plow mixer together with 75 g of Zeolite 4A and run at 200 rpm for 30 seconds. Following mixing, the material is screened using an 1800 μm sieve to remove the oversize. The product passing through the screen is the soft-solid intermediate high active perfume material.

Example 3

Preparation of the Hardened-solid Intermediate High Active Perfume Material

The material from example 2 is fed into a Niro 6 inch (15.24 cm) diameter fluidising apparatus in 500 g batches using the following conditions to produce a hardened solid intermediate high active perfume particle.

Residence time: until the temperature of the pre-mix is 20° C. (~5 minutes)

Air velocity: 0.5 m/s

Air temperature: 15° C.

| Component | % w/w of hardened solid intermediate |
|---|---|
| $TAE_{80}$ | 24.0 |
| Delta Damascone | 9.6 |
| Polyethyleneimine | 6.4 |
| Light sodium carbonate | 38.5 |
| Ester modified carboxymethyl cellulose | 16.5 |
| Zeolite 4A | 5.0 |

Example 4

Preparation of the Perfume Composition

The final perfume composition is produced by contacting 450 g of the material from example 3 with 1050 g of light sodium carbonate using an AICHI drum mixer Type RM-10-3 at 20° C. The drum mixer is operated at 50 rpm for one minute producing the composition described in the table below.

| Component | % w/w of perfume composition |
|---|---|
| $TAE_{80}$ | 7.20 |
| Delta Damascone | 2.88 |
| Polyethyleneimine | 1.92 |
| Light sodium carbonate | 81.55 |
| Ester modified carboxymethyl cellulose | 4.95 |
| Zeolite 4A | 1.50 |

Example 5

Laundry Detergent Compositions

Examples of laundry detergent compositions comprising the perfume composition are included below.

| | % w/w of laundry detergent compositions | | | |
|---|---|---|---|---|
| Ingredient | A | B | C | D |
| $C_{9-13}$ linear alkyl benzene sulphonate (LAS) | 7.1 | 6.7 | 11.0 | 10.6 |
| $C_{12-18}$ alkyl ethoxylated sulphate having an average degree of ethoxylation of 3 (AES) | 3.5 | 0.0 | 1.5 | 0.0 |
| Copolymer of Maleic/Acrylic Na salt | 3.6 | 1.8 | 4.9 | 2.0 |

-continued

| | % w/w of laundry detergent compositions | | | |
|---|---|---|---|---|
| Ingredient | A | B | C | D |
| Zeolite A | 4.0 | 0.5 | 0.8 | 1.4 |
| Sodium tri-poly phosphate | 0.0 | 17.5 | 0.0 | 15.8 |
| Sodium carbonate | 23.2 | 16.8 | 30.2 | 17.3 |
| Sodium sulphate | 31.4 | 29.4 | 36.5 | 7.2 |
| Sodium silicate (1.6R) | 0.0 | 4.4 | 0.0 | 4.5 |
| $C_{12-18}$ alkyl ethoxylated alcohol having an average degree of ethoxylation of 7(AE7) | 0.4 | 2.6 | 0.8 | 2.5 |
| Sodium percarbonate | 16.0 | 0.0 | 8.4 | 20.4 |
| Sodium perborate | 0.0 | 9.9 | 0.0 | 0.0 |
| Tetraacetyl ethylenediamine (TAED) | 2.2 | 1.7 | 0.0 | 4.7 |
| Perfume composition of example 4 | 0.7 | 0.4 | 0.6 | 0.7 |
| Miscellaneous and moisture | to 100% | to 100% | to 100% | to 100% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for preparing a laundry detergent composition, the process comprising the steps of;

(a) contacting a perfume ingredient with a molten material to form a pre-mix;

(b) contacting the pre-mix with a first solid material to form a soft-solid intermediate high active perfume material;

(c) solidifying the molten material and the first solid material from step (b) to form a hardened-solid intermediate high active perfume material;

(d) contacting the hardened-solid intermediate high active perfume material of step (c) with a second solid material to form a perfume composition, wherein the ratio of the wt % amount of perfume ingredient present in the hardened-solid intermediate high active perfume material of step (c) to the wt % amount of perfume ingredient present in the perfume composition of step (d) is greater than about 1.5:1

(e) adding the perfume composition of step (d) to a laundry detergent composition.

2. A process according to claim 1, wherein step (d) is carried out at a temperature below the crystallization peak temperature of the molten material.

3. A process according to claim 1, wherein step (c) is carried out at a temperature below the crystallization peak temperature of the molten material.

4. A process according to claim 1, wherein step (b) is carried out at a temperature above the melting peak temperature of the molten material.

5. A process according to claim 1, wherein the ratio of the wt % amount of perfume ingredient present in the hardened-solid intermediate high active perfume material to the wt % amount of perfume ingredient present in the perfume composition is greater than about 2:1.

6. A process according to claim 1, wherein the perfume ingredient comprises the product of a chemical reaction between an amine compound and an aldehyde or a ketone.

7. A process according to claim 1, wherein the perfume ingredient comprises the product of a reaction between delta damascone and a polyethyleneimine.

8. A process according to claim 1, wherein the hardened-solid intermediate high active perfume material comprises at least about 14 wt % perfume ingredient.

9. A process according to claim 1, wherein the perfume composition comprises less than about 7 wt % perfume ingredient.

10. A process according to claim 1, wherein the molten material comprises an ethoxylated $C_8$-$C_{24}$ alcohol having an average degree of ethoxylation of from about 25 to about 100.

11. A process according to claim 1, wherein the first solid material comprises sodium carbonate.

12. A process according to claim 1, wherein the second solid material comprises sodium carbonate.

13. A process according to claim 1, wherein the first solid material comprises light sodium carbonate.

14. A process according to claim 1, wherein the second solid material comprises light sodium carbonate.

* * * * *